US007579535B2

(12) United States Patent
Pyper-Scott

(10) Patent No.: US 7,579,535 B2
(45) Date of Patent: Aug. 25, 2009

(54) FOLDING ELECTRONIC INSTRUMENT

(76) Inventor: Irene Pyper-Scott, 487 Kenepuru Road, RD2, Picton 7372 (NZ)

( * ) Notice: Subject to any disclaimer, the term of this patent is extended or adjusted under 35 U.S.C. 154(b) by 0 days.

(21) Appl. No.: 11/906,544

(22) Filed: Oct. 2, 2007

(65) Prior Publication Data

US 2009/0084243 A1 Apr. 2, 2009

(51) Int. Cl.
*G10D 3/00* (2006.01)

(52) U.S. Cl. ..... 84/293; 84/267

(58) Field of Classification Search ..... 84/290, 84/293, 291, 267

See application file for complete search history.

(56) References Cited

U.S. PATENT DOCUMENTS

2004/0182220 A1* 9/2004 Strobel ..... 84/267

OTHER PUBLICATIONS

Publication website materials at http://cachepe.zzounds.com/media/quality,85/brand,zzounds/EZAG.

Publication website materials at http://www.zzounds.com/item—YAMEZAG.

Publication website materials at http://shredneck.com/products.html.

Publication website materials at http://www.lapstick.com/whatis.htm.

* cited by examiner

*Primary Examiner*—Kimberly R Lockett

(74) *Attorney, Agent, or Firm*—Weingarten, Schurgin, Gagnebin & Lebovici LLP

(57) ABSTRACT

A portable electronic stringed instrument is disclosed. The folding instrument includes a neck portion and a body portion and a connection portion for connecting the neck portion to the body portion. A plurality of adjustable neck strings are disposed between a nut and a neck bridge on the neck portion and a plurality of adjustable body strings are disposed between a nut and a body bridge on the body portion. A finger placement sensor array is disposed on the neck portion proximate the frets and the neck strings. A string vibration sensor is disposed on the body portion proximate the body strings. Although the approximate length of the neck portion can be about 8 to about 12 inches, the fret board on the neck portion includes a plurality of frets that are precisely spaced to provide the fret spacing of a standard, 25.6- to 26-inch "scale length" acoustical guitar.

8 Claims, 5 Drawing Sheets

FOLDING ELECTRONIC INSTRUMENT

CROSS REFERENCE TO RELATED APPLICATIONS (Not applicable)

STATEMENT REGARDING FEDERALLY SPONSORED RESEARCH OR DEVELOPMENT (Not applicable)

FIELD AND BACKGROUND OF THE INVENTION

This invention relates to a folding electronic stringed instrument, such as an electronic guitar, and, more particularly, to a folding, electronic, stringed instrument having an overall length that is significantly shorter than that of a conventional stringed instrument but, that, nevertheless, preserves the fret spacings that are disposed across the neck portion of the stringed instrument at intervals corresponding to fret or note spacings of the conventional stringed instrument.

Stringed instruments, such as guitars, banjos, violins, fiddles, cellos, violas, basses, and the like, produce sound when at least one string is bowed, plucked, picked, strummed, or activated in some way, so as to displace and release the string, causing it to vibrate. By controlling the effective vibrating length of the manipulated string by shortening them with fingers on finger boards or fret boards, one can obtain a desired frequency or pitch. The combination of activated strings at desired frequencies creates the music we love.

A myriad of various stringed instruments in a multitude of forms has been producing music back into dim history, gradually evolving to the present form. For example, FIG. 1 shows an elevation view of a conventional modern 6 string guitar 10. The guitar 10 includes a neck 12 with a fret board 9 having frets 11. A thin walled body 14, and a head 16 are placed at opposite ends of the neck 12 with pegs 17 for tightening strings. A plurality of strings 15 are tightly strung at various tensions above the fret board 17, between the pegs 17 of head 16 over a nut 13 and a bridge stop assembly 18 of the body 14. The bridge stop assembly has a strap 19 and string tie holes at 21 to transfer vibration to the top plate 23 of body 14.

Typically, to provide or play different notes or chords at various pitches (frequencies), one hand (or a hand-held device such as a pick or bow) of the musician picks, plucks, strums or draws a bow along at least one string 15 proximate to the body 14 of the stringed instrument 10 to activate it while the musician's other hand varies the vibrating length of the string(s) 15 being bowed, picked, plucked or strummed by stopping the strings at one or more frets 11*a*-11*n*. The vibrating length of a string 15 is thus reduced to the length of the string between the raised fret 11*a*-11*n* that the string is stopped against and the bridge stop 18 of the stringed instrument 10.

The raised frets 11*a*-11*n*, typically, are metal strips that are disposed transversely across the fret board 9 of neck 12 at precisely calculated distances from the nut 13. The frets 11 divide the neck 12 into fixed segments that are related to the musical framework of the present "equal tempered" scales. Each fret 11 spacing represents a semitone or half note (C to C# for example), wherein twelve semitones make up an octave. Necessarily, the distance between adjacent frets 11 making up the fret board on the neck 12 of a guitar 10 reduce exponentially in keeping with the exponential relationship of notes in modern scales A-G. The twelfth fret is one half the distance between nut and bridge, the fifth fret is one quarter that distance, etc.

Over the centuries, whereas the shape and form of stringed instruments have been and still are the subject of art, style, and whimsy, many of the functional aspects of the instrument have been, to a large degree, standardized. For example, in the mid- to late-19$^{th}$ Century, master craftsman Antonio de Torres is credited with crafting guitars having a scale length of 650 millimeters (about 25.6 inches). "Scale length" refers to the effective vibrating length of an instrument string and is measured from the fret board side of the nut 13 to the body side of the bridge stop 18. This scale length, since, has been almost universally adopted for acoustic guitars, both classical and country. Indeed, in the present age, most acoustic guitars are manufactured with a scale length between about 25.5 and about 26 inches, while bass (electric) guitars are manufactured with a scale length of about 34 inches.

According to basic musical theory, the ratio of the distances between consecutive frets ($D_1/D_2$), such as fret 11*a* and fret 11*b* in FIG. 2, to the bridge stop 18 is equal to $2^{1/12}$, or approximately equal to 1.069463. Hence, the distance between one fret and the next on up the board, Dn to Dn+1, is $1/1.069463$ times the distance, Dn−1 to Dn, between that fret and the next lower fret closer to the nut.

Consequently, the distances between consecutive frets, such as between fret 11*a* and fret 11*b*, between fret 11*b* and fret 11*c*, and so forth, on the fret board 9 are standardized for all acoustic guitars having a scale length of about 25.6 inches. In actual measurement, the distance between fret 11*a* and fret 11*b* on a conventional acoustic guitar is approximately 1.44 inches, the distance between fret 11*b* and fret 11*c* is approximately 1.36 inches, and so forth.

As a result, musicians who have developed a feel for the fret board 9 and the fret spacing ($D_f$) of a conventional acoustical guitar are accustomed to the pre-determined fret locations associated with a 25.6 inch scale length. This poses problems when trying to reduce the size of the stringed instrument to make a small travel instrument. Musicians do not want to compromise their sense of spacing gained over thousands of hours of practice.

U.S. Pat. No. 6,791,022 to Green provides a stringed musical instrument that can be contracted into a smaller volume for ease of transport and storage. According to the teachings of Green, however, the instrument retains its standard neck length and body size and shape. U.S. Pat. No. 6,957,157 to Strobel provides a portable, travel, standard scale length guitar that includes standard sized body and neck portions that are releasably attached and detached. In both instances, however, the size of the re-assembled stringed instrument is substantially the same size as a conventional, standard scale length guitar. Also the effort to assemble and disassemble is a disincentive to use and only when disassembled is the size and volume of the stringed instrument reduced.

Therefore, it would be desirable to provide a portable, electronic stringed instrument, such as an electronic guitar, that is substantially reduced in size and volume from a conventional, standard scale length guitar when both in a folded and an unfolded state but that provides standard fret spacing on the neck of the stringed instrument while creating true, in-tune notes.

BRIEF SUMMARY OF THE INVENTION

A portable folding electronic stringed instrument is disclosed. The folding instrument includes a neck portion and a body portion and a connection portion for connecting the neck portion to the body portion. A plurality of adjustable neck strings are disposed between a nut and a neck bridge on the neck portion and a plurality of adjustable body strings are disposed between a nut and a body bridge on the body portion.

The arrangement of strings and frets creates a matrix that can be used to read finger placement electronically. A string vibration sensor senses plucking or other activation of a string and is disposed on the body portion proximate a terminus of the strings. Electronics detect combined finger placement and string activation to produce the note corresponding to that provided by the same finger placement and string activating of a normal guitar. Although the approximate length of the neck portion can be about 8 to about 12 inches, the fret board on the neck portion includes a plurality of frets that are precisely spaced to provide the fret spacing of a standard, 25.6- to 26-inch "scale length" acoustic guitar.

BRIEF DESCRIPTION OF THE SEVERAL VIEWS OF THE DRAWINGS

The foregoing and other objects, features, and advantages of the invention will be apparent from the following more particular description of preferred embodiments of the invention, as illustrated in the accompanying drawings in which like reference characters refer to the same parts throughout the different views.

DETAILED DESCRIPTION OF THE INVENTION

For convenience and clarity, various aspects of the present invention are disclosed with reference to a stringed instrument and, more particularly, to an electronic guitar. However, those skilled in the art will appreciate the applicability of the teachings of the present invention to other electronic, stringed instruments, such as banjos, violins, fiddles, cellos, violas, basses, and the like, which are included within the scope and spirit of this disclosure. Likewise, more frets may be fingered than strings activated for any one note.

A portable, stringed instrument having electronic means for sensing, amplifying, and reproducing audio representations of string vibrations that are associated with a conventional stringed instrument, such as an electronic guitar, is disclosed. Referring to FIGS. 3-7, there is shown a portable electronic guitar 50 comprising a neck portion 52, a body portion 64, and a hinging mechanism 70 shown in FIG. 7 for folding the neck portion 52 over the body portion 64 but maintaining them in the open position as shown in FIGS. 3-7.

Figure 1:
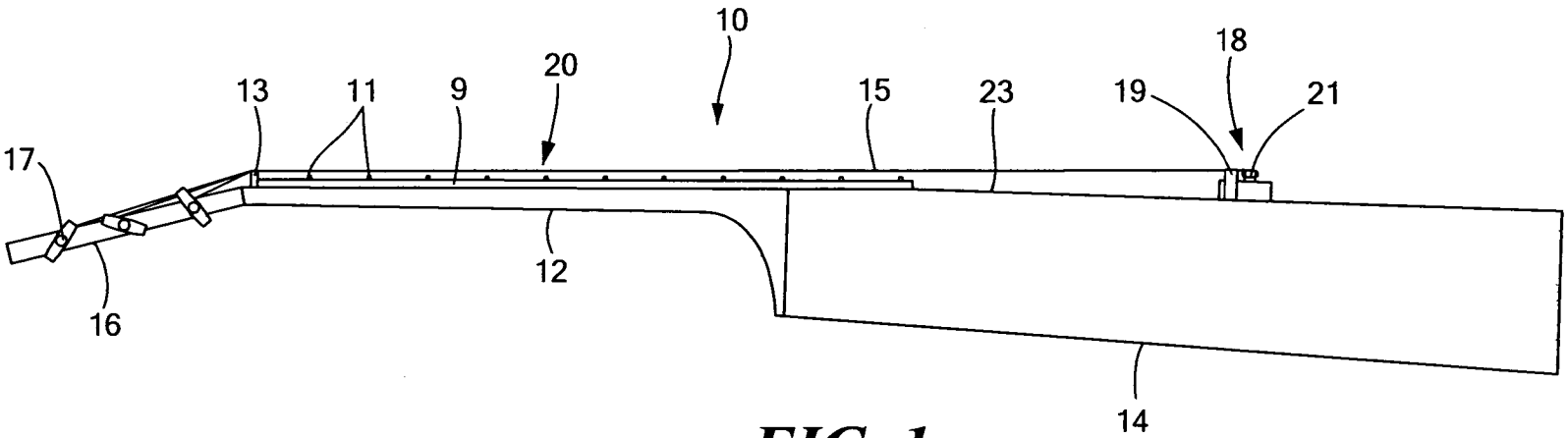
FIG. 1 PRIOR ART
FIG. 1 is a diagrammatic elevation view of a conventional guitar.
Figure 2:
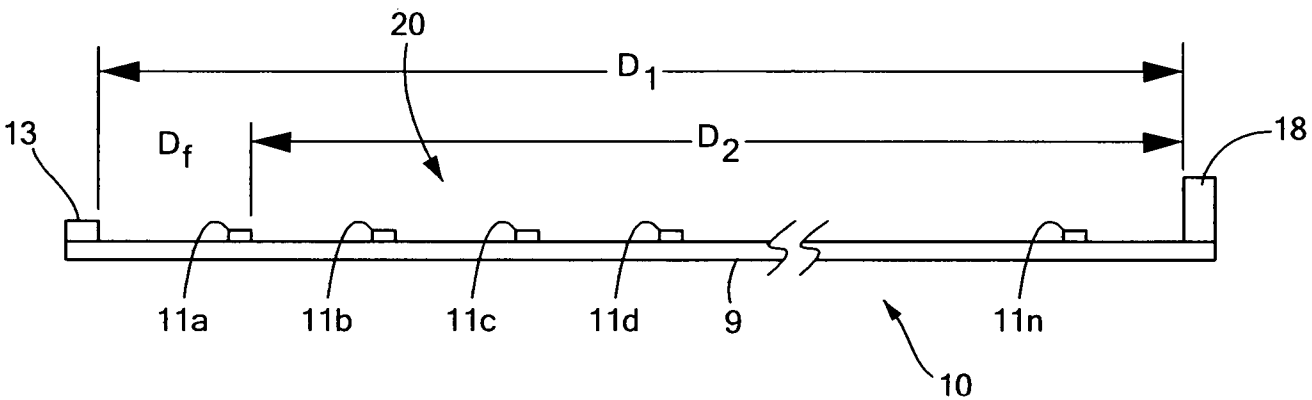
FIG. 2 PRIOR ART
FIG. 2 is a diagram of a fret board showing the scale lengths and distance between consecutive frets.
Figure 3:
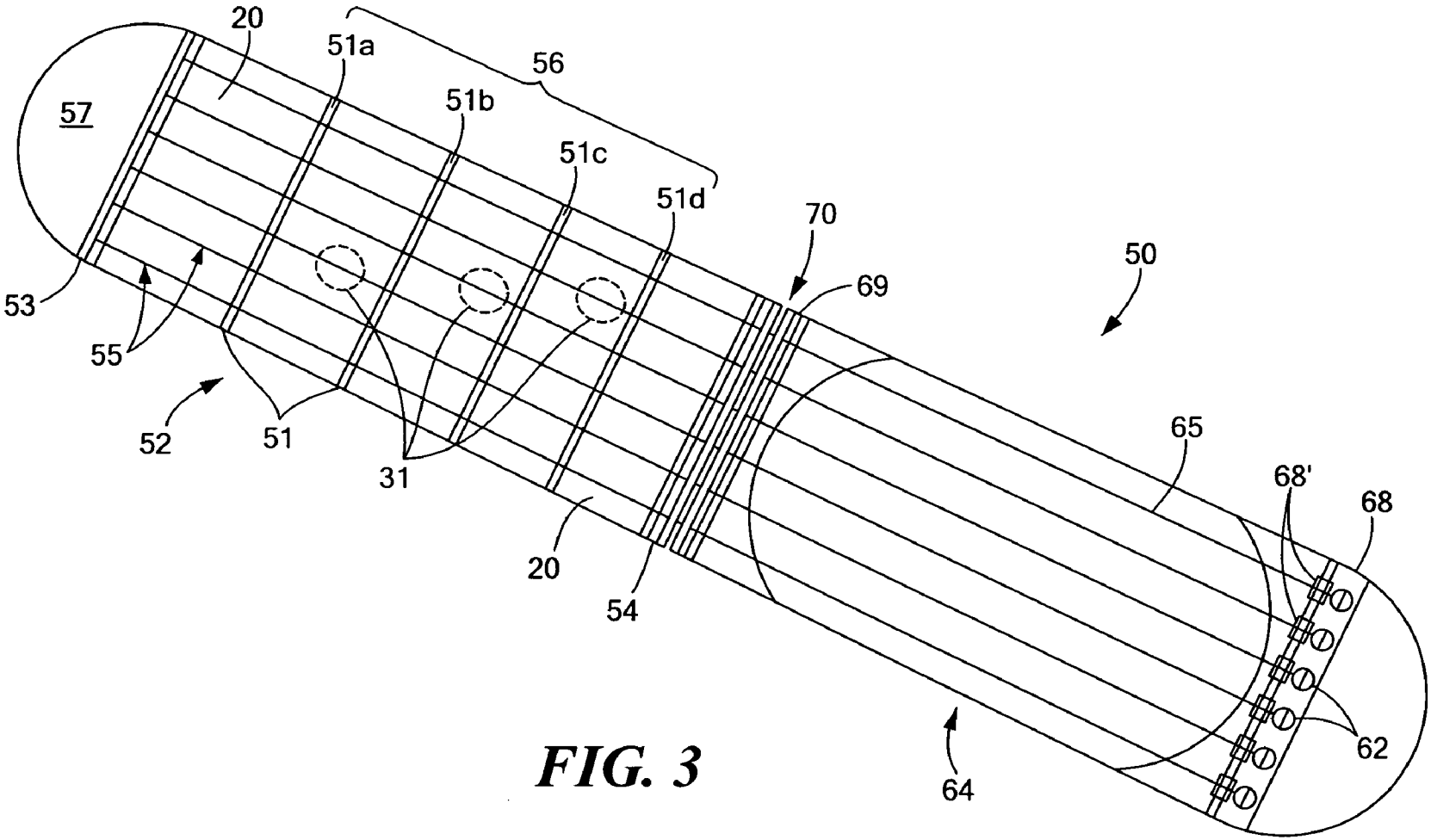
FIG. 3 is a diagrammatic top view of a portable stringed instrument in accordance with the present invention in its opened state.
Figure 4:
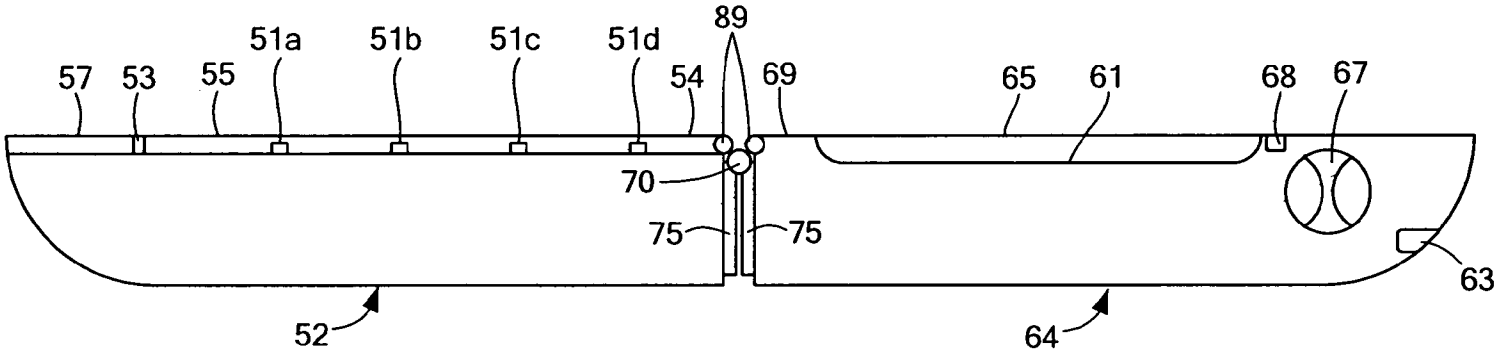
FIG. 4 is a diagrammatic side elevation of a portable stringed instrument in accordance with the present invention.
Figure 5:
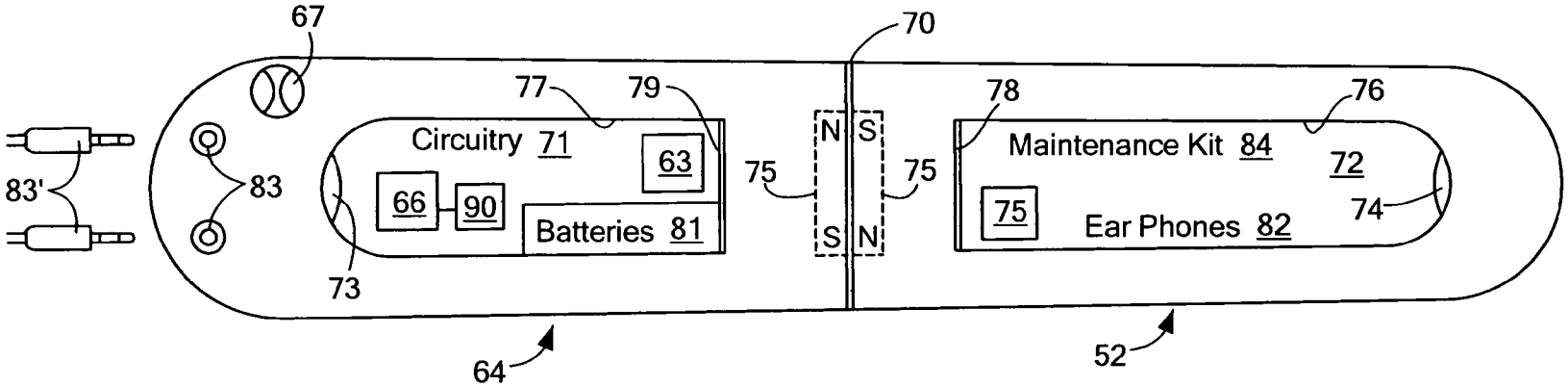
FIG. 5 is a diagrammatic top view of a portable stringed instrument in accordance with the present invention.

The neck portion 52, as well as the body portion 64, of the portable electronic guitar 50 is between about 8 and about 12 inches long and has the approximate width found on a standard acoustical guitar. The neck portion 52 includes a neck head portion 57, a nut 53, a plurality of frets 51 disposed in a fret board 57 and a neck bridge 54 at opposite ends of the fretted portion. The nut 53 plurality of frets 51 and finger board 20, whether or not a separate piece, on the neck portion 52 are adapted to have the same size, dimensions, and orientation of corresponding elements of a standard acoustic guitar, to convey the feel of a standard acoustic guitar. More particularly, the distance between adjacent frets 51 on the neck portion 52 of the portable electronic guitar 50 are the same as the distance between the corresponding first frets on a standard acoustic guitar, notwithstanding, that the "scale length" of the neck strings 55 is much reduced. For example, the distance between fret 51*a* and fret 51*b* on the portable electronic guitar 50 in FIG. 3 is approximately 1.44 inches, the distance between fret 51*b* and fret 51*c* is approximately 1.36 inches, and so forth. However, models can be made where the frets correspond to those above a capo key change position.

Figure 6:
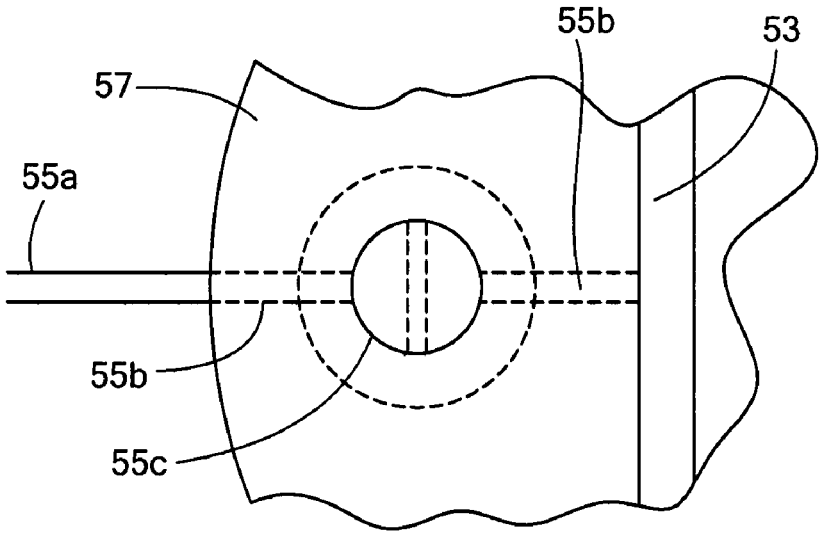
FIG. 6 is a diagrammatic view of string tighteners in the head of the neck portion.

A plurality of adjustable neck strings 55 are stretched tightly between the nut 53 and the neck bridge 54. The fixed end of strings 55 and 65 are held by knots or other mechanism at 89. The tension on each of the plurality of neck strings 55 is individually alterable or, alternatively, all of the neck strings 55 are collectively alterable. For example, as shown in FIG. 6, the free ends 55*a* of the neck strings 55 can be disposed through holes 55*b* in the head portion 57 and around individual tightening pins 55*c* as in normal guitars or, alternatively, around a common tightening rod, both arranged below the surface of and within the head portion 57 or to fit in recesses of the body portion 64 when folded. A tightening wrench, key or other device can engage mating portions of pins 55*c* to rotate the tightening pin(s) to provide a desired tension to each individual neck string 55 or, alternatively, to all of the neck strings 55 jointly. The strings stretch over the frets 51*a*-51*n* the same distance above the frets that is common on normal guitars. Discarded strings may be used to save cost.

Sound from the portable electronic guitar 50 is produced electronically, therefore, tension on the neck strings 55 is not critical because the neck strings 55 do not have to be in tune. The serious musician, however, may prefer his or her strings 55 to be tightened to a tension substantially similar to the tension on the strings of his or her standard acoustic guitar.

In the body portion 64 strings 65 are stretched between nut and bridge type elements 89 and 68 in the same or similar manner to those in neck portion 52. The bridge 68 has, for example, piezo-electric sensors of the type found in electric string instruments to sense string vibration and magnitude as known in the art. Tighteners of the type shown in FIG. 6 may be used in the end portion 67.

On the outside of the folding instrument opposite strings 55 and 65 are preferably hatches 71 and 72 with openers 73 and 74 and lip portions 88 and 77 the hatches fit under.

Under hatch 71 in the body portion are semiconductor circuits 66 and 63 described below. A battery compartment 81 provides operating power from batteries therein.

The neck portion 52 hatch 72 encloses electronics 75 for fingered fret sensing. Space exists for earphones 82 and a maintenance kit 83 under hatch 72.

Figure 7:
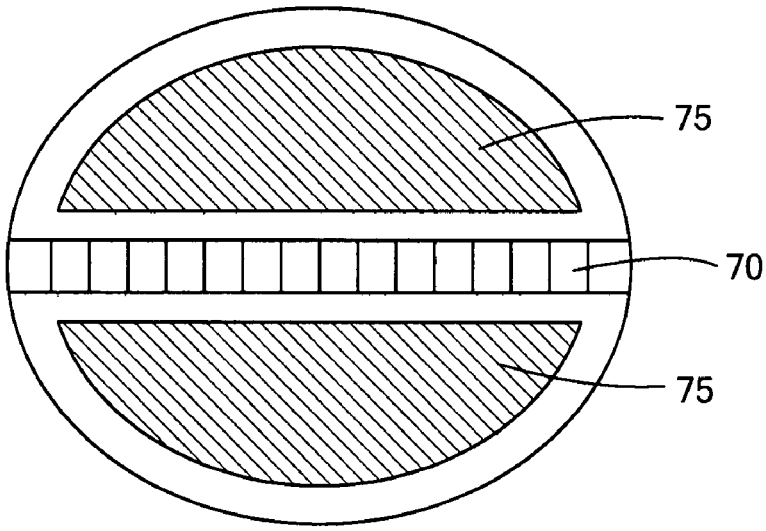
FIG. 7 is a detail of a hinge mechanism in a folded state for the portable stringed instrument in accordance with the present invention.
Figure 8:
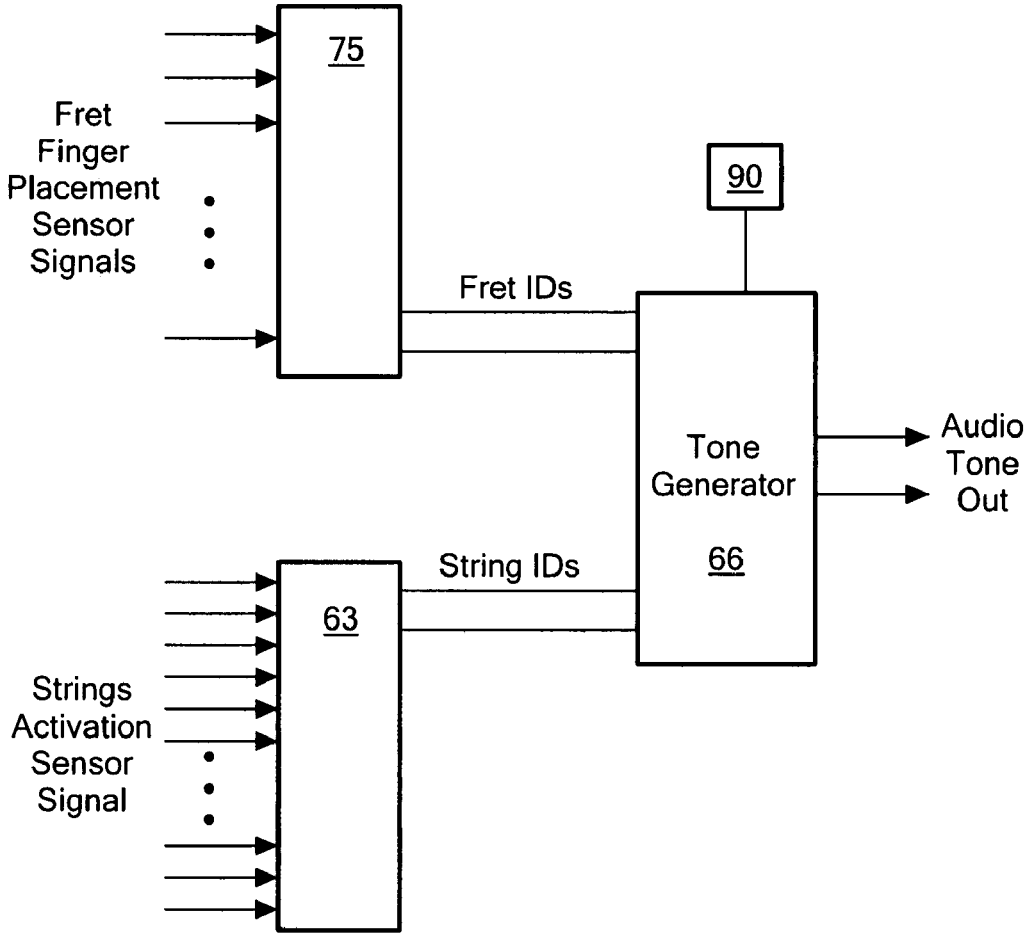
FIG. 8 is a schematic view of circuitry for generating audio tones corresponding to the combination of frets fingered and strings activated.

Magnetic elements 75 as shown in FIG. 7 hold the two halves open and a hinge 70 pivots them between open and closed.

FIG. 3 shows areas 31 adjacent each fret where a typical finger placement occurs, just in front of each fret 51. Since the strings and frets form an XY matrix conventional matrix sensing of string to fret contact may be used. In this case, the fingering of a fret is likely to also cause string to fret electrical contact to both frets 51 bordering the finger placement areas 31 so the electronics 75 identifies the fret nearest the bridge. One form of XY matrix detection is to consecutively and separately apply a small signal to each fret in a repeating cycle and while each fret has its signal applied, each string is consecutively and separately sensed for the presence of a signal by electronics 75. In the case where there are no frets, the position of contact between string and finger board can use, for example, a finger board with many cross-wires embedded in it using the same approach as above or a resistive finger board with a voltage sensitive detector system.

Electronics 63 respond to the piezo signals to provides an indication of which string(s) are activated and in what magnitude as is known in the art.

Fingered fret and activated string data is provided to a tone generator 66 having stored sequencer tones to send the appropriate guitar tones to output jacks 83 for plugs 83' on earphones of amp inputs. Guitarists can have their own guitar's tones recorded for use in the sequencing operation of tone generator 66.

The guitar shown has 5 frets; typically less than an octave will be present but six to eleven frets are possible. In the case of a fretless finger board, the same is true, i.e. less than an octave but sixths and sevenths intervals are possible. In the fretless case, a control 90 maybe added to the tone generator 66 to cause the instrument to play as in the $2^{nd}$, $3^{rd}$, $5^{th}$ or other position up the finger board.

For minimum costs the instrument may be provided without any electronics. In this case, the playing retains a feel of a real instrument without sound generation.

What is claimed is:

1. A folding string instrument having dimensions a small fraction of the dimensions of a full size instrument and comprising:

a neck portion having a finger board with neck strings and means for sensing a fingering position of a neck string onto the finger board;

a body portion connected by a hinge mechanism to the neck portion and having body strings and means for sensing vibrational activation of each neck string separately;

means associated with said neck and/or body portion for identifying combinations of neck string fingering position and body string activation wherein magnets are provided to maintain said neck and body portions in an orientation wherein said neck and body strings form extensions of each other.

2. The instrument of claim 1 wherein said combination identifying means includes means for producing accompanying audio tone(s).

3. The instrument of claim 2 including means for changing the audio tone to correspond to positions higher up the finger board.

4. The instrument of claim 1 wherein said finger board has frets positioned at intervals corresponding to a full sized version of said instrument.

5. The instrument of claim 1 wherein said full size instrument is selected from the group consisting of a guitar, a banjo, a mandolin, a violin, a viola, a cello and derivatives thereof.

6. A folding string instrument having dimensions a small fraction of the dimensions of a full size instrument and comprising:

a neck portion having a finger board with neck strings between a nut and string holders on opposite ends of the finger board;

a body connected by a hinge to the neck portion and having body strings between string attachments points;

said neck and body portions folding over each other and having a length to the neck portion finger board which is a fraction of an octave in length compared to the full size instrument; and magnetic means for maintaining said neck and body portions in an orientation wherein said neck and body strings form extensions of each other.

7. The instrument of claim 6 wherein said finger board has frets positioned at intervals corresponding to the full sized instrument.

8. The instrument of claim 6 wherein said full size instrument is selected from the group consisting of a guitar, a banjo, a mandolin, a violin, a viola, a cello and derivatives thereof.

* * * * *